US006259214B1

(12) United States Patent
Doell et al.

(10) Patent No.: US 6,259,214 B1
(45) Date of Patent: Jul. 10, 2001

(54) METHOD FOR OPERATING A DISCHARGE LAMP

(75) Inventors: Gerhard Doell, Ulm; Hartwig Riehl, Heidenheim; Martin Enders, Munich, all of (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/593,383

(22) Filed: Jun. 14, 2000

(30) Foreign Application Priority Data

Jun. 23, 1999 (DE) ..... 199 28 438

(51) Int. Cl.[7] ..... H05B 41/16

(52) U.S. Cl. ..... 315/246; 31/254; 31/260; 31/291; 313/607

(58) Field of Search ..... 315/246, 254, 315/260, 334, 326, 339, 291, 358, DIG. 2, DIG. 5; 313/497, 607

(56) References Cited

U.S. PATENT DOCUMENTS 5,523,655 * 6/1996 Jennato et al. ..... 315/246
5,604,410 * 2/1997 Vollkommer et al. ..... 315/246
5,965,988 * 10/1999 Vollkommer et al. ..... 315/246
6,157,145 * 12/2000 Vollkommer et al. ..... 315/339

FOREIGN PATENT DOCUMENTS 197 18 395 10/1998 (DE) .
96/36066 11/1996 (WO) .

* cited by examiner

*Primary Examiner*—Haissa Philogene
(74) *Attorney, Agent, or Firm*—Carlo S. Bessone

(57) ABSTRACT

An operating method, in particular a dimming method for a discharge lamp. In order to set the maximum brightness, two outer electrodes (5,6), for example, are used to generate in the discharge lamp a dielectrically impeded discharge which, through the formation of xenon excimers, emits UV radiation which is converted into light with the aid of fluorescent materials (2). In order to permit intense dimming of the discharge lamp, two cold cathodes (3, 4) are used to generate a xenon low-pressure discharge emitting UV beams, and the dielectrically impeded discharge is switched off. Both types of discharge are preferably excited by high-voltage pulses which are generated by an operating unit (7). Dimming is preferably performed by blanking pulse trains.

8 Claims, 2 Drawing Sheets

METHOD FOR OPERATING A DISCHARGE LAMP

Figure 1:
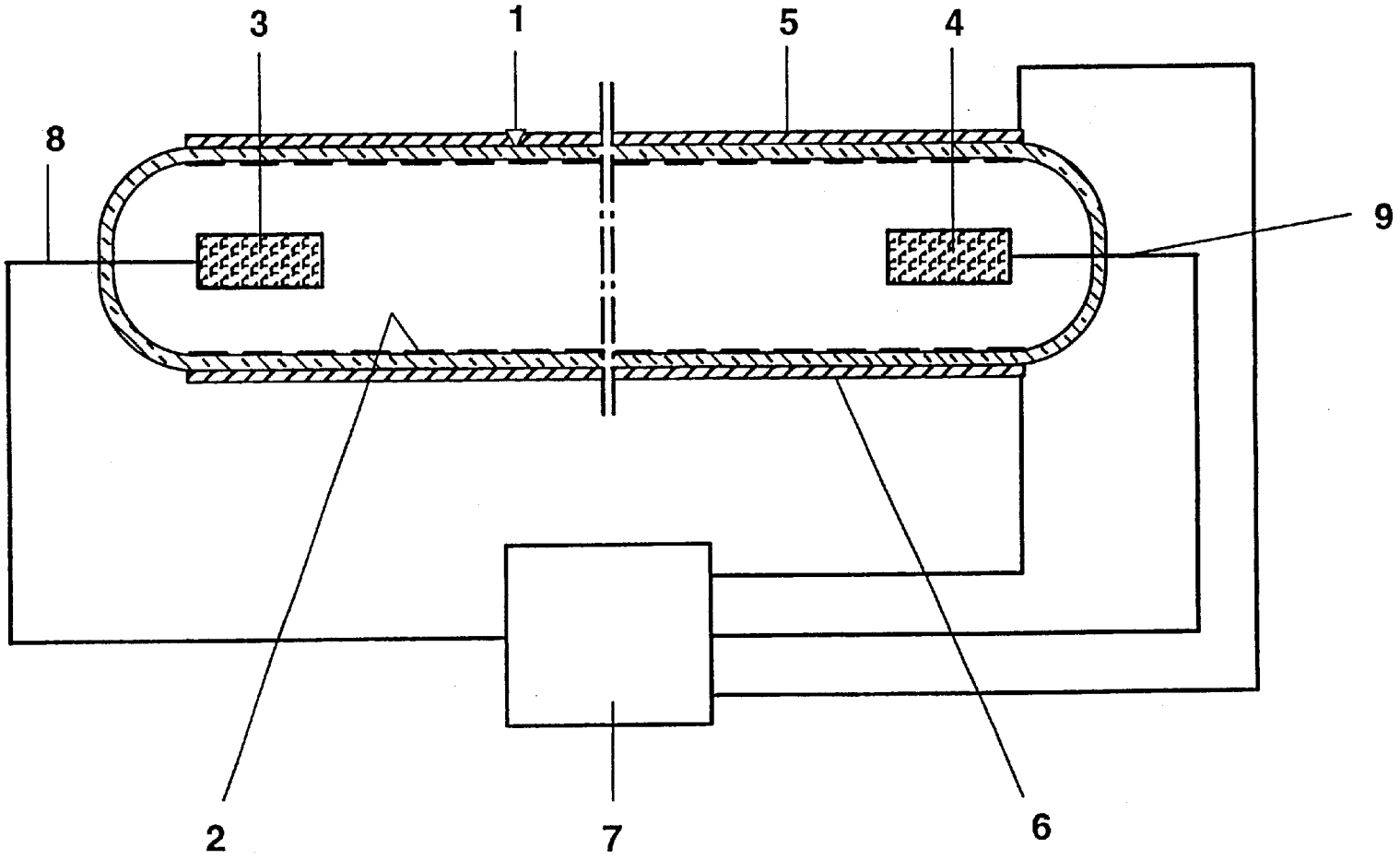

The invention relates to a method for operating a discharge lamp in which a first dielectrically impeded discharge and a second dielectrically unimpeded discharge are generated in the discharge lamp.

I. PRIOR ART

Such a method is disclosed, for example, in laid-open patent application WO 96/36066. This publication describes an operating method for a discharge lamp in which a first, dielectrically impeded discharge and a second, dielectrically unimpeded discharge are generated in the discharge lamp. The dielectrically impeded discharge is superimposed on the dielectrically unimpeded discharge, or made to precede it temporally. The color locus of the light emitted by the discharge lamp is specifically set via the ratio of the electric powers of both discharges. Neon gas serves as discharge medium. The dielectrically impeded discharge generates neon excimers which emit as they decay UV radiation which is, in turn, converted into light by means of a fluorescent material, while the dielectrically unimpeded discharge emits predominantly red light. This method does not permit dimming of the discharge lamp, since changes in the electric power of the two discharges lead to a shift in the color locus of the emitted light.

II. SUMMARY OF THE INVENTION

It is the object of the invention to provide a method for operating a discharge lamp in which a dielectrically impeded and a dielectrically unimpeded discharge are generated in the discharge lamp, and which permits brightness control of the light emitted by the discharge lamp. Moreover, the aim is to dispense with the use of mercury in the discharge lamp.

This object is achieved according to the invention by means of the characterizing features of claim 1. Particularly advantageous designs of the invention are described in the subclaims.

The operating method according to the invention generates in the discharge lamp two different gas discharges, specifically a dielectrically impeded discharge and a dielectrically unimpeded discharge, xenon being used as discharge medium in both cases. According to the invention, by forming xenon excimers, the dielectrically impeded discharge generates ultraviolet radiation which is converted into light by fluorescent materials, while the dielectrically unimpeded discharge is formed as a xenon low-pressure discharge emitting ultraviolet radiation, the UV radiation emitted by the xenon low-pressure discharge likewise being converted into light by fluorescent materials. In the brightness control of the light emitted by the discharge lamp, according to the invention the dielectrically impeded discharge is generated for the purpose of setting the undimmed operating state, and the xenon low-pressure discharge is generated for the purpose of setting a dimmed operating state.

This mode of operation of the discharge lamp according to the invention unites with one another the high light yield of a dielectrically impeded discharge and the good dimmability of a low-pressure discharge. Since xenon gas is used as a discharge medium, it is predominantly ultraviolet radiation which is produced in the case both of the dielectrically impeded and the low-pressure discharges, which radiation is converted into white light or monochromatic light by fluorescent materials, with the result that it is possible to dispense with the addition of mercury in the discharge space. The color of the light emitted by the discharge lamp is determined only by the fluorescent materials. Consequently, the mode of operation according to the invention produces no color locus shifts by changing the electric power of the two types of discharge. It is advantageously only the dielectrically impeded discharge which is generated for the purpose of setting the undimmed operating state in the discharge lamp, since said discharge ensures a higher light yield than the dielectrically unimpeded discharge. In order to reduce the brightness, the electric power of the dielectrically impeded discharge is firstly advantageously reduced, and for the purpose of further reducing the brightness, the dielectrically impeded discharge is switched off and only the xenon low-pressure discharge is generated, the electric power of the xenon low-pressure discharge being set as a function of the desired brightness or dimming stage. The xenon low-pressure discharge can be dimmed to a substantially greater extent than the dielectrically impeded discharge, without having to fear extinction of the discharge or without the occurrence of an inhomogeneous discharge.

The dielectrically impeded discharge is advantageously generated by means of two outer electrodes which are mounted on the outer surface of the discharge vessel in order to ensure a discharge which is as homogeneous as possible. The dielectrically unimpeded discharge is advantageously generated by means of two cold cathodes arranged inside the discharge vessel. In order to generate the dielectrically impeded discharge, the two outer electrodes are advantageously subjected to high-voltage pulses, while for the purpose of generating the xenon low-pressure discharge, the cold cathodes are advantageously subjected to a medium-frequency AC voltage or to high-voltage pulses.

DESCRIPTIONS OF THE DRAWINGS

Figure 2:
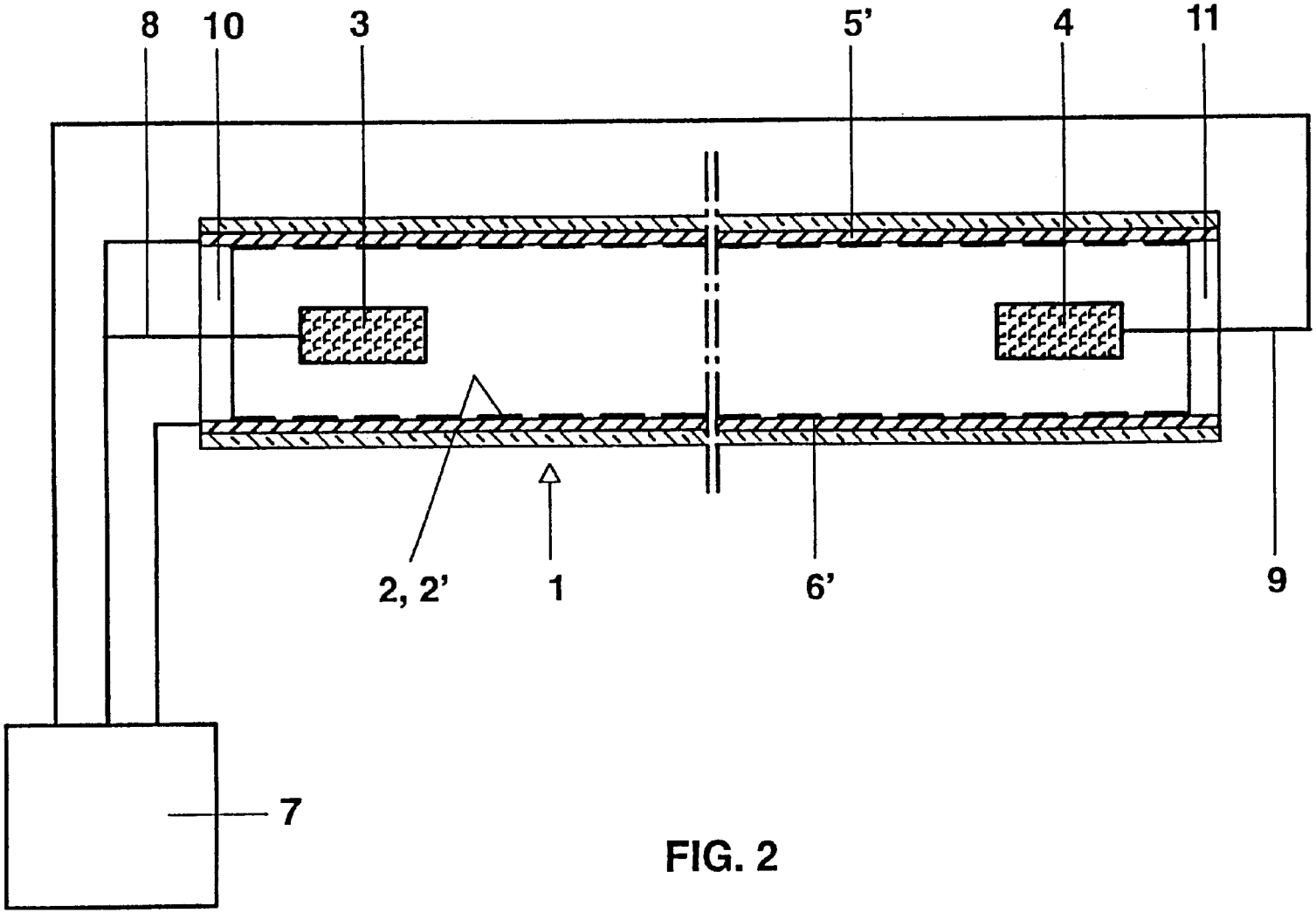

FIG. 1 shows a schematic representation of a discharge lamp and an operating unit according to the teachings of the present invention; and FIG. 2 shows a schematic representation of discharge lamp and an operating unit according to another embodiment of the invention.

III. DESCRIPTION OF THE PREFERRED EXEMPLARY EMBODIMENT

The invention is explained in more detail below with the aid of a preferred exemplary embodiment. FIG. 1 shows a schematic representation of a discharge lamp with the aid of which the method according to the invention is described in more detail. This discharge lamp serves, for example, as display back lighting for a display device in motor vehicles or aircraft.

The discharge lamp has a tubular glass discharge vessel 1 which is closed at the ends in a gastight fashion, has a length of approximately 160 mm and a diameter of approximately 9 mm and is coated on the inside with fluorescent material 2. The two ends of the discharge vessel 1 are fitted in each case with a cup-like cold cathode 3, 4 projecting into the interior of the discharge vessel 1. The cold cathodes 3, 4 are connected to an operating unit 7 by means of supply leads 8, 9 sealed in a gastight fashion in the ends of the discharge vessel 1. Two outer electrodes 5, 6 extending in the longitudinal direction and situated opposite one another are applied to the outer surface of the discharge vessel 1. Xenon with a filling pressure of approximately 15 kPa is located in the interior of the discharge vessel 1. The outer electrodes 5, 6 are subjected to high-voltage pulses with the aid of the operating unit 7 in order to set the undimmed operating state of the discharge lamp. These are unipolar, negative voltage pulses of approximately 3 to 5 kV with pulse widths of approximately 2–3 μs and pulse spacings of approximately 10 μs. A dielectrically impeded discharge forms in the interior of the discharge vessel 1 transverse to the longitudinal extent of the discharge vessel 1. Xenon excimers which decay while emitting ultraviolet radiation are generated in this discharge. The ultraviolet radiation is converted into white light by the fluorescent material layer 2. In order to reduce the brightness of the lamp slightly, the electric power of the dielectrically impeded discharge is reduced by blanking pulse trains. This dimming method permits only a comparatively slight reduction in the brightness, specifically only in the ratio of 20:1, since in the case of excessively strong blanking of the pulse trains inhomogeneous discharging with brightness which varies spatially over the lamp results. In order to permit a further, steeper reduction in brightness, a xenon low-pressure discharge is ignited via the cold cathodes 3, 4 by means of the operating unit 7, and the dielectrically impeded discharge is switched off. The cold cathodes 3, 4 are subjected to high-voltage pulses of approximately 5 to 10 kV and a pulse width of approximately 1 μs as well as a pulse repetition frequency of approximately 20 kHz in order to generate the xenon low-pressure discharge. The UV radiation produced in the discharge is converted into white light by the fluorescent material layer 2. The xenon low-pressure discharge is dimmed by blanking pulse trains at blanking frequencies above 75 Hz. The brightness of the discharge lamp can be continuously dimmed in this way in the ratio of 1000 to 1. The high-voltage pulses for the cold cathodes 3, 4 and for the outer electrodes 5, 6 are generated by the same operating unit 7.

The invention is not limited to the exemplary embodiment explained in more detail above. For example, the xenon low-pressure discharge can also be generated by a medium-frequency AC voltage instead of by high-voltage pulses. Moreover, the method according to the invention can also be applied to lamps which have dielectrically impeded inner electrodes 5', 6' instead of the dielectrically impeded outer electrodes 5, 6. A lamp with such inner electrodes 5', 6' is illustrated very schematically in FIG. 2. The inner electrodes 5', 6' are designed here as mutually opposite metal strips which extend in the longitudinal direction and are fitted directly on the inner wall of the discharge vessel 1. The inner wall of the discharge vessel 1 is provided with a fluorescent material layer 2 and, if appropriate, with a further dielectric 2', with the result that the metal strips 5', 6' are arranged between the inner wall of the discharge vessel 1 and the fluorescent material layer 2 and/or the dielectric 2'. The dielectrically impeded discharge forms perpendicular to the metal strips 5', 6'. The cold cathode discharge is generated by means of two cup electrodes 3, 4 arranged in the end seals 10, 11 of the tubular discharge vessel 1. However, it is also possible to apply the method according to the invention to lamps which in addition to the cold cathodes have one or more inner electrodes and one or more outer electrodes for generating the dielectrically impeded discharge. Such a lamp is disclosed, for example, in German Patent DE 197 18 395 C1.

What is claimed is:

1. A method for operating a discharge lamp, a first, dielectrically impeded discharge and a second, dielectrically unimpeded discharge being generated in the discharge lamp, wherein by forming xenon excimers, UV radiation is generated by means of the first, dielectrically impeded discharge, the second, dielectrically unimpeded discharge is a xenon low-pressure discharge emitting UV radiation, the UV radiation generated by the two discharges is converted into visible light by means of one or more fluorescent materials (2;2'), and the brightness of the discharge lamp is controlled by generating the dielectrically impeded discharge for the purpose of setting an undimmed state in the discharge lamp, and by generating the xenon low-pressure discharge for the purpose of setting a dimmed state in the discharge lamp.

2. The method as claimed in claim 1, wherein only the dielectrically impeded discharge is generated for the purpose of operating the discharge lamp in the undimmed state, the electric power of the dielectrically impeded discharge is firstly reduced in order to reduce the brightness of the discharge lamp, and the dielectric discharge is switched off for the purpose of further reducing the brightness of the discharge lamp and only the xenon low-pressure discharge is generated, the electric power of the xenon low-pressure discharge being set as a function of the desired brightness.

3. The method as claimed in claim 1, wherein the dielectrically impeded discharge is generated by means of two outer electrodes (5,6) which are mounted on the outer surface of the discharge vessel (1).

4. The method as claimed in claim 1, wherein the dielectrically impeded discharge is generated by means of two strip-shaped inner electrodes (5',6') which are mounted on the inner wall of the discharge vessel (1).

5. The method as claimed in claim 1, wherein the xenon low-pressure discharge is generated by means of two cold cathodes (3,4) arranged inside the discharge vessel (1).

6. The method as claimed in claim 1, wherein the dielectrically impeded discharge is generated with the aid of high-voltage pulses.

7. The method as claimed in claim 1, wherein the xenon low-pressure discharge is generated with the aid of medium-frequency AC voltages or high-voltage pulses.

8. The method as claimed in claim 6, wherein the brightness control is performed by blanking pulse trains.

* * * * *